US007313851B2

(12) United States Patent
Wang et al.

(10) Patent No.: US 7,313,851 B2
(45) Date of Patent: Jan. 1, 2008

(54) METHOD FOR MONITORING THE INSTALLATION OF BLIND RIVETS

(75) Inventors: Pei-Chung Wang, Troy, MI (US); James W. Wells, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 31 days.

(21) Appl. No.: 11/341,539

(22) Filed: Jan. 27, 2006

(65) Prior Publication Data

US 2007/0175010 A1 Aug. 2, 2007

(51) Int. Cl.
*B21J 15/28* (2006.01)

(52) U.S. Cl. ..... 29/243.523; 72/21.1; 72/21.4; 227/2

(58) Field of Classification Search ..... 29/243.519–243.529; 72/391.2, 391.4, 391.6, 72/21.1, 21.4; 227/2
See application file for complete search history.

(56) References Cited

U.S. PATENT DOCUMENTS 4,580,435 A 4/1986 Port et al.
5,027,631 A * 7/1991 Naito ..... 72/443
5,600,878 A * 2/1997 Byrne et al. ..... 29/243.525
5,661,887 A * 9/1997 Byrne et al. ..... 29/243.525
5,666,710 A * 9/1997 Weber et al. ..... 29/243.523
6,612,013 B2 9/2003 Zardus et al.
7,024,746 B2 * 4/2006 Weeks et al. ..... 29/243.519

* cited by examiner

*Primary Examiner*—David B Jones

(57) ABSTRACT

Apparatus is provided for monitoring the installation of a blind rivet to attach together top and bottom members. The blind rivet installation tool includes a housing having an anvil seated on the rivet head. A collet is reciprocable within the tool housing and carries jaws for gripping the mandrel of the blind rivet. Retraction of the jaws by the collet displaces the jaws and the mandrel axially and causes the mandrel head to axially collapse and radially expand the hollow shank of the blind rivet into engagement with the bottom member so that the rivet attaches the top member and the bottom member. A first transducer measures the axial load imposed on the mandrel. A second transducer measures the axial displacement of the collet and the jaws and the mandrel.

7 Claims, 4 Drawing Sheets

METHOD FOR MONITORING THE INSTALLATION OF BLIND RIVETS

FIELD OF THE INVENTION

The present invention relates to an improved method for blind riveting together a set of members.

BACKGROUND OF THE INVENTION

It is known to attach together a set of members using a blind rivet assembly. The use of a blind rivet to attach members together is particularly useful in the assembly or repair of vehicle bodies or other applications in which access can be obtained to only one side of one of the members (a top member), with the other member (a bottom member) being hidden and inaccessible below the top member.

It would be desirable to provide improvements in the blind rivet method of attaching members together. For example, improvements to make such attachments more reliable by electronically monitoring the installation of the blind rivet.

SUMMARY OF THE INVENTION

Apparatus is provided for monitoring the attachment together of top and bottom members by the installation of a blind rivet of the type having a rivet head abutting the top member and a hollow shank reaching through aligned holes of the top and bottom members and having a terminal end, and a mandrel including a stem extending through the hollow shank of the rivet and a mandrel head adjacent the terminal end of the rivet shank. A tool housing has an anvil seated on the rivet head. A collet is reciprocable within the tool housing and carries jaws for gripping the mandrel. Retraction of the jaws by the collet displaces the jaws and the mandrel axially and causes the mandrel head to axially collapse and radially expand the hollow shank of the blind rivet into engagement with the bottom member so that the rivet attaches the top member and the bottom member. A first transducer measures the axial load imposed on the mandrel. A second transducer measures the axial displacement of the collet and the jaws and the mandrel therewith.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

Figure 1:
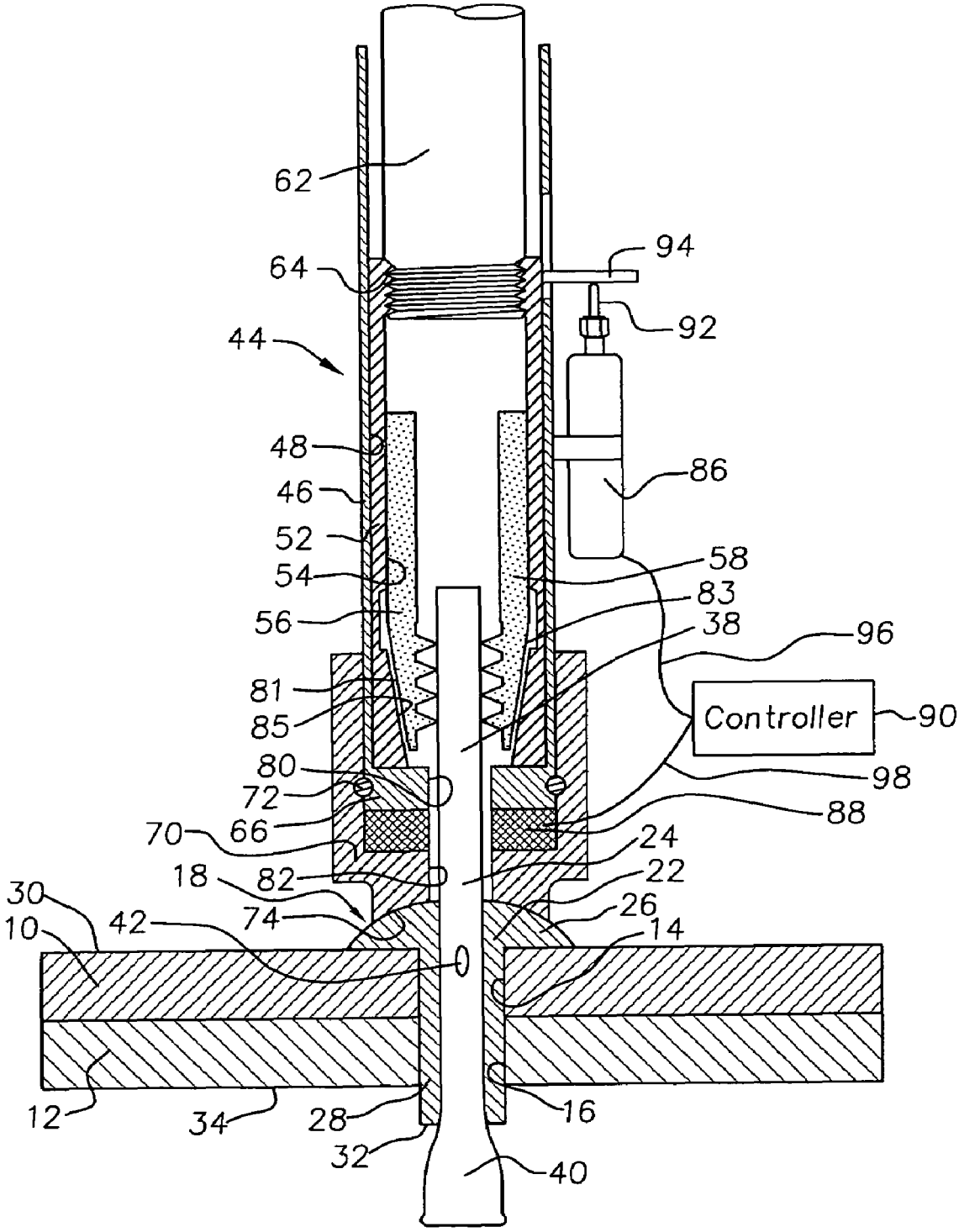
FIG. 1 is a section view through a top member and a bottom member that are to be attached together and showing a tool and monitoring system for installing a blind rivet seated in aligned holes in the members.

Referring to FIG. 1, a top member 10 is a sheet metal panel and a bottom member 12 is a sheet metal panel. The top member and the bottom member are to be attached together. However, one or more additional components or members may be stacked between the top and bottom members.

A hole 14 is drilled, pierced, or otherwise provided through the top member 10 and an aligned hole 16 is provided in the bottom member 12.

A blind rivet assembly 18 is inserted through the aligned holes 14 and 16. The blind rivet assembly 18 includes a blind rivet 22 and a mandrel 24.

The blind rivet 22 has a rivet head 26 and a hollow rivet shank 28 that are integrally formed in one piece. The rivet head 26 rests on the top face 30 of the top member 10. The hollow rivet shank 28 extends through the aligned holes 14 and 16 and is somewhat longer than the combined thickness of the top and bottom members 10 and 12 and has terminal end 32 that ends somewhat beyond the bottom face 34 of the bottom member 12.

The mandrel 24 includes a stem 38 that extends through the blind rivet 22 and has an enlarged mandrel head 40 at its terminal end. As seen in FIG. 1, the mandrel 24 is longer than the length of the blind rivet 22 so that the stem 38 extends well above the rivet head 26 of the blind rivet 22. The mandrel head 40 is larger than the inner diameter of the hollow rivet shank 28 of the blind rivet 22, but smaller than the diameter of the aligned holes 14 and 16 so that the blind rivet assembly 18 can be inserted through the aligned holes 14 and 16. The mandrel stem 38 has a weakness, particularly a fracture notch at 42 to define a fracture region in the stem 38, as will be discussed hereinafter.

Referring to FIG. 1, a blind rivet installation tool, generally indicated at 44 is used to install the blind rivet assembly 18. The tool includes a tubular tool housing 46 having a bore 48. A collet sleeve 52 is slideable within the bore 48 of tubular tool housing 46 and has a collet cavity 54. A plurality of jaws, two of which are shown as jaws 56 and 58, are carried within the collet cavity 54 of the collet sleeve 52.

The upper end of the collet sleeve 52 is attached to a drive shaft 62 by threads 64. The drive shaft 62 is connected to an operating mechanism, such as a pneumatic cylinder, hydraulic cylinder, electric motor, or the like, for forcibly reciprocating the collet sleeve 52 within the tubular tool housing 46.

The lower end of the collet sleeve 52 is partly closed by an end wall 66 that is normally engaged by the lower end of the collet sleeve 52 as shown in FIG. 1. An annular anvil housing 70 is seated on the lower end of the collet sleeve 52 and attached thereto by a retaining ring 72. The lower end of the anvil housing forms an anvil surface 74 that is shaped to seat upon the rivet head 26 of the blind rivet 22.

As seen in FIG. 1, the lower end of the collet sleeve 52 has an aperture 80 that aligns with an aperture 82 in the annular anvil housing 70. These apertures 80 and 82 cooperate to receive the mandrel stem 38 when the installation tool 44 is lowered onto the blind rivet assembly 18 as shown in FIG. 1. In FIG. 1, the tool is shown with the anvil surface 74 pressed against the rivet head 26 and the jaws 56 and 58 poised against the mandrel stem 38.

Figure 2:
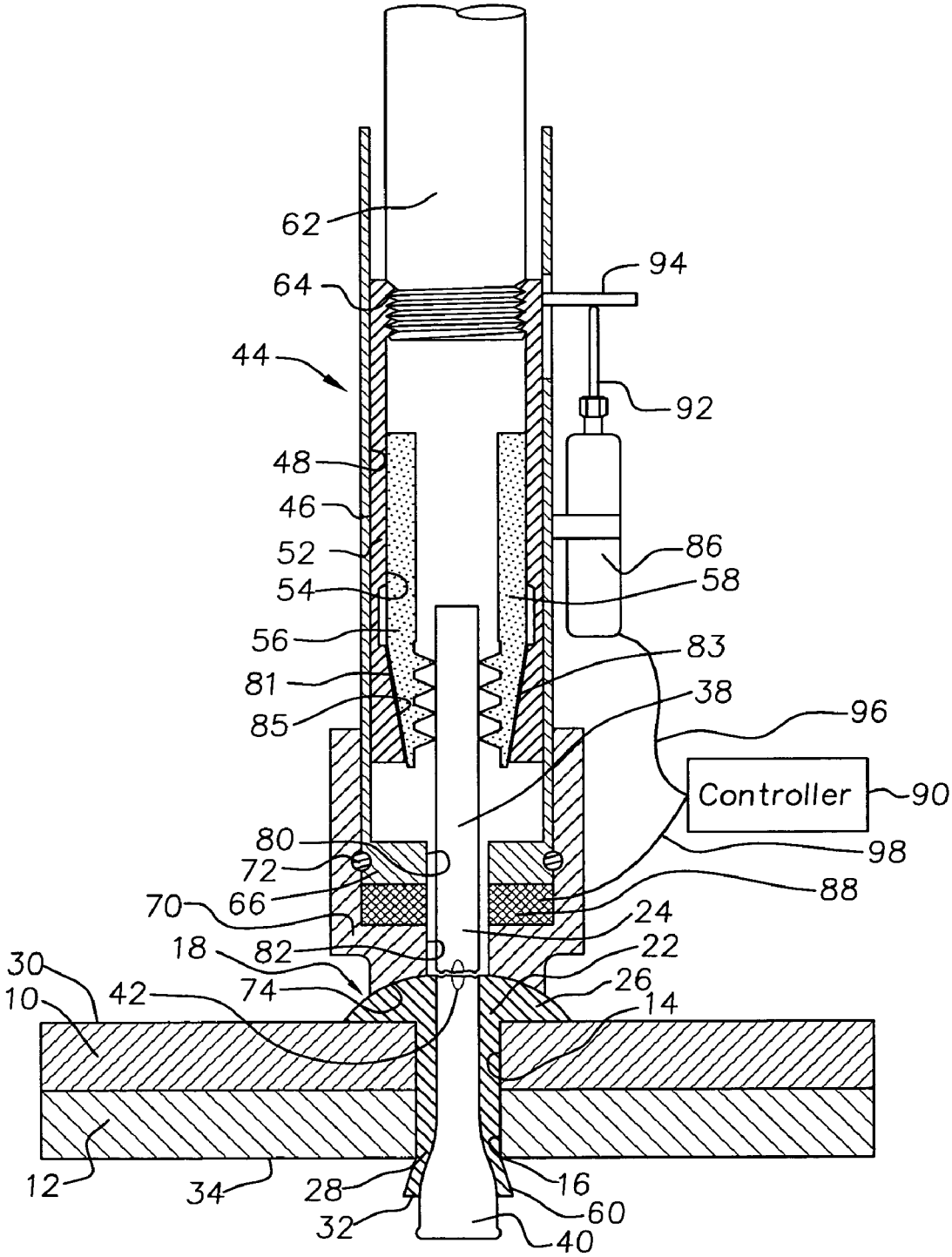
FIG. 2 is a view similar to FIG. 1 but showing actuation of the tool to install the blind rivet.

In FIG. 2, it is seen that the operating mechanism has been operated causing the drive shaft 62 to retract the collet sleeve 52 upwardly. The jaws 56 and 58 have cam surfaces 81 and 83 at their outer sides that bear upon a mating annular cam surface 85 of the collet sleeve 52. These cam surfaces act in manner to cause the jaws 56 and 58 to be lifted upwardly with the collet sleeve and also urge the jaws 56 and 58 inwardly to securely grip the mandrel stem 38 so that the mandrel stem 38 is lifted in unison with the collet sleeve 52, the jaws 56 and 58, and the drive shaft 62. It will be appreciated that the jaws 56 and 58 are shown with teeth that assure effective gripping of the mandrel stem 38. The mandrel stem 38 may also be provided with grooves, not shown, to further promote gripping by the jaws 56 and 58.

In FIG. 2, the jaws 56 and 58 have been forcibly withdrawn causing the mandrel stem 38 to have been drawn upwardly so that the mandrel head 40 has contacted the terminal end 32 of the rivet shank 28 and worked to axially collapse and radially expand the rivet shank 28 to form an expanded head 60 that engages with the underside 34 of the lower member 12. Thus, the top member 10 and the bottom member 12 are tightly captured between the rivet head 22 and the expanded head 60 of the rivet shank 28, thereby fastening together the top member 10 and the bottom member 12. FIG. 2 also shows that the mandrel stem 38 has fractured, as facilitated by the fracture notch 42.

A monitoring system for monitoring the installation tool includes a displacement sensor 86 that measures the displacement of the collet sleeve 52, a load cell washer 88 that measures the axial load imposed upon the mandrel stem 38, and an electronic controller 90.

More particularly, the displacement sensor 86 is preferably a linear variable differential transformer that is mounted on the tool housing 46 and has a spring loaded plunger 92 that follows an arm 94 that projects from the side of the collet sleeve 52. Alternatively the transducer 86 may be a commercially available optical displacement sensor. The transducer 86 is electrically connected to the electronic controller 90 by a cable 96.

The load cell washer 88 is interposed between the lower end of the collet sleeve 52 and the anvil housing 70. It will be understood that as the jaws 56 and 58 and the collet sleeve 52 forcibly lift the mandrel stem 38 upwardly, there is an equal and opposite reaction force that is imposed upon the anvil housing 70 and is sensed by the load cell washer 88. The load cell washer 88 is connected to the electronic controller 90 by a cable 98.

Figure 3:
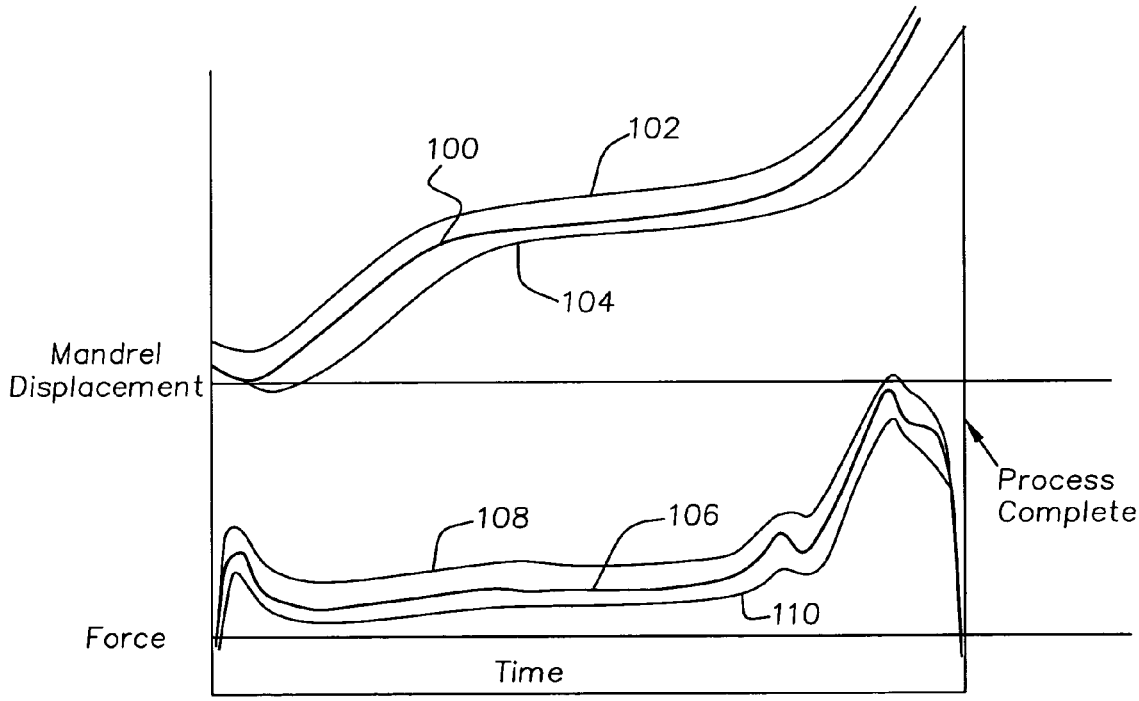
FIG. 3 is a graph which plots the displacement of the jaws and mandrel, and axial load, versus time.

Referring to FIG. 3, a graph is shown to display the displacement and force characteristics of the blind rivet installation process. In particular curve 100 is a plot of the displacement of the collet sleeve 52, and thus the mandrel stem 38 that is lifted in unison with the collet sleeve 52 and its jaws 56 and 58. Curves 102 and 104 are plotted respectively above and below the curve 100 and represent an upper control limit and a lower control limit. Curve 106 is a plot of axial force experienced by the anvil housing 70 and the mandrel 24, and has an upper control limit 108 and lower control limit 110.

Figure 4:
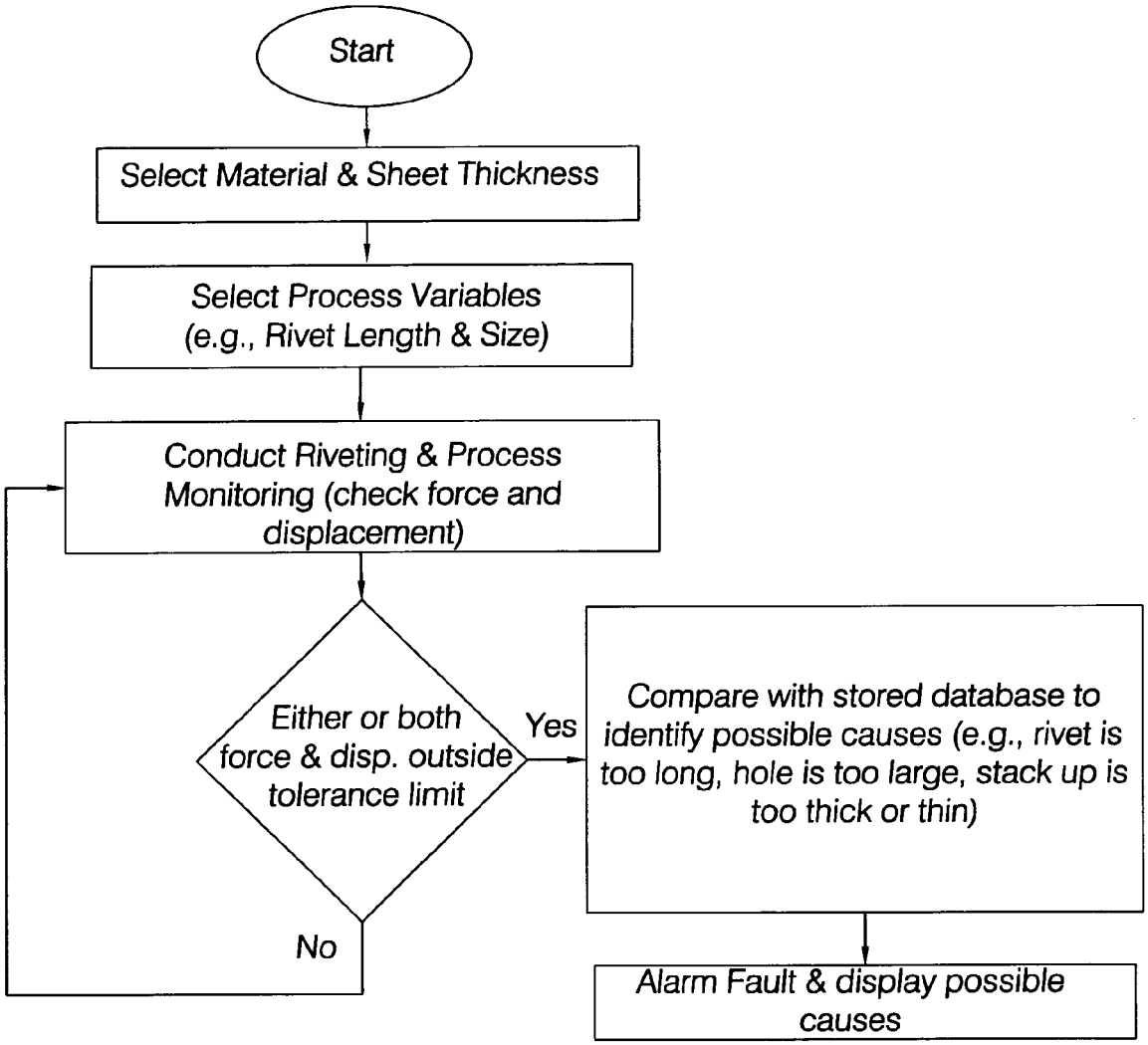
FIG. 4 is a flow chart showing the installation and monitoring process.

It will be understood and appreciated that the electronic controller 90 will monitor the mandrel displacement and axial force during the conduct of the blind rivet installation process and may perform any of a number of monitoring and control functions as shown in the flow chart of FIG. 4. For example the monitoring system and process controller 90 may be reset to attach together different thicknesses of material stackup. The monitoring system may simply provide reports and fault alarms as shown in the flow chart. Or the process controller 90 may initiate automatic adjustment of the stroke and force of the collet sleeve in the event that the process is operating outside the normal control limits for any of the monitored conditions.

It will be understood that the foregoing description of the invention is merely exemplary in nature and, thus, variations thereof are intended to be within the scope of the invention. For example, the drawings show sensors for sensing both displacement and force. However, it may be found useful to monitor either one of these conditions, without the other. In addition, other known displacement transducers and force measuring transducers may be substituted for those specifically described herein. Furthermore, although the drawings show the load cell as associated with the anvil, it may be desirable to mount the load cell with the drive shaft or the collet sleeve to measure the force applied to the mandrel by the installation tool. And although the drawings show only a top member and bottom member being attached by the blind rivet, the monitoring system of this invention can also be used when three or more members or components are stacked together.

What is claimed is:

1. An installation monitoring apparatus for monitoring the attachment together of stacked top and bottom members by the installation of a blind rivet having a rivet head abutting the top member and a hollow shank reaching through aligned holes of the top and bottom members and having a terminal end, and a mandrel including a stem extending through the hollow shank of the rivet and a mandrel head adjacent the terminal end of the rivet shank; comprising:

a tool housing having an anvil seated on the rivet head;

a collet reciprocable within the tool housing and carrying jaws for gripping the mandrel and retracting the jaws to thereby displace the jaws and the mandrel axially and cause the mandrel head to axially collapse and radially expand the hollow shank of the blind rivet into engagement with the bottom member so that the rivet attaches the top member and the bottom member;

a transducer for measuring the axial load imposed on the mandrel and a linear variable differential transformer mounted on the tool housing and having a spring loaded probe that engages with an arm carried by the collet so that the spring loaded probe follows the axial displacement of the collet for measuring the axial displacement of the collet and the jaws therewith.

2. The apparatus of the claim 1 in which the, transducer measuring the axial load imposed on the mandrel is a load cell that is mounted within the tool housing, and the load cell senses the force exerted on the anvil by the rivet head in reaction to the force applied to the mandrel.

3. An installation monitoring apparatus for monitoring the attachment together of top and bottom stacked members by the installation of a blind rivet having a rivet head abutting the top member and a hollow shank reaching through aligned holes of the top and bottom members and having a terminal end, and a mandrel including a stem extending through the hollow shank of the rivet and a mandrel head adjacent the terminal end of the rivet shank; comprising:

a tool housing having an anvil seated on the rivet head;

a collet reciprocable within the tool housing and carrying jaws for gripping the mandrel and retracting the jaws to thereby displace the jaws and the mandrel axially and cause the mandrel head to axially collapse and radially expand the hollow shank of the blind rivet into engagement with the bottom member so that the rivet attaches the top member and the bottom member;

a transducer for measuring the axial load imposed on the mandrel; and, an optical displacement sensor that is mounted on the housing and observes an arm carried by the collet for measuring the axial displacement of the collet and the jaws therewith.

4. The apparatus of claim 3 in which the transducer measuring the axial load imposed on the mandrel is a load cell that is mounted within the tool housing, and the load cell senses the force exerted on the anvil by the rivet head in reaction to the force applied to the mandrel.

5. An installation monitoring apparatus for monitoring the attachment together of members by the installation of a blind rivet having a rivet head abutting the one member and a hollow shank reaching through aligned holes of the members and having a terminal end, and a mandrel including a stem extending through the hollow shank of the rivet and a mandrel head adjacent the terminal end of the rivet shank; comprising:

a tool housing having an anvil housing mounted thereon and the anvil housing being seated on the rivet head;

a collet reciprocable within the tool housing and carrying jaws for gripping the mandrel and retracting the jaws to thereby displace the jaws and the mandrel axially and cause the mandrel head to axially collapse and radially expand the hollow shank of the blind rivet into engagement with the other member so that the rivet attaches the members together;

a load cell interposed between the tool housing and the anvil housing for measuring the axial load imposed thereon during the installation of the blind rivet;

a displacement sensor associated with the collet for measuring the axial displacement of the collet and the jaws therewith during the installation of the blind rivet;

and a data recording controller device that monitors the measured displacements and force to enable monitoring and control of the installation tool during installation of the blind rivet.

6. The apparatus of claim 5 in which the displacement sensor is a linear variable differential transformer mounted on the tool housing and having a spring loaded probe that engages with an arm carried by the collet so that the spring loaded probe follows the axial displacement of the collet.

7. The apparatus of claim 5 in which the displacement sensor is an optical displacement sensor that is mounted on the housing and observes an arm carried by the collet.

* * * * *